US006044927A

United States Patent [19]

Newlin

[11] Patent Number: 6,044,927

[45] Date of Patent: Apr. 4, 2000

[54] WORK PLATFORM LIFT MACHINE WITH SCISSOR LIFT MECHANISM EMPLOYING TELESCOPABLE ELECTRO-MECHANICAL BASED LIFT ACTUATION ARRANGEMENT

[75] Inventor: Enoch L. Newlin, Waynesboro, Pa.

[73] Assignee: Zefer Operations, Inc., Fairfield, Pa.

[21] Appl. No.: 09/158,866

[22] Filed: Sep. 23, 1998

[51] Int. Cl.[7] ..... E06C 1/00

[52] U.S. Cl. ..... 182/69.5; 182/69.6; 182/141; 254/101

[58] Field of Search ..... 182/12, 13, 14, 182/16, 63.1, 69.1, 69.2, 69.3, 69.4, 69.5, 69.6, 141, 148; 74/89.15, 841; 254/9 C, 98, 101, DIG. 1; 403/78, 127

[56] References Cited

U.S. PATENT DOCUMENTS

| | | | |
|---|---|---|---|
| 706,807 | 8/1902 | Dixon et al. | 254/101 |
| 867,531 | 10/1907 | Potter | 254/10 |
| 1,042,662 | 10/1912 | Fillion . | |
| 1,498,813 | 6/1924 | Sawkela et al. | 187/269 |
| 1,545,223 | 7/1925 | Westlake . | |
| 2,043,887 | 6/1936 | Dement | 254/9 C |
| 2,188,686 | 1/1940 | Kersting et al. | 187/269 |
| 2,445,004 | 7/1948 | Reynolds et al. | 187/269 |
| 2,975,868 | 3/1961 | Long | 187/18 |
| 3,259,367 | 7/1966 | Squire | 254/101 |
| 3,319,933 | 5/1967 | Gray | 254/101 |
| 3,329,402 | 7/1967 | Grumman | 254/101 X |
| 3,361,410 | 1/1968 | Messer | 254/101 |
| 3,817,346 | 6/1974 | Wehmeyer | 182/148 X |
| 4,123,039 | 10/1978 | Vig | 254/9 C |
| 4,146,208 | 3/1979 | Ciccarelli | 254/DIG. 1 X |
| 4,405,116 | 9/1983 | Eisenberg | 254/122 |
| 4,627,602 | 12/1986 | Sporck | 254/98 X |
| 4,725,183 | 2/1988 | Smillie, III | 414/345 |
| 4,867,277 | 9/1989 | Sloan | 187/9 R |
| 5,125,280 | 6/1992 | Koscinski et al. | 74/89.15 |
| 5,271,113 | 12/1993 | White | 254/9 C X |
| 5,379,855 | 1/1995 | Juang | 187/269 |
| 5,664,762 | 9/1997 | Rothbauer | 254/DIG. 1 X |

FOREIGN PATENT DOCUMENTS

| | | | |
|---|---|---|---|
| 817338 | 7/1959 | United Kingdom | 254/101 |

*Primary Examiner*—Daniel P. Stodola
*Assistant Examiner*—Richard M. Smith
*Attorney, Agent, or Firm*—Michael R. Swartz; John R. Flanagan

[57] ABSTRACT

A scissors-type work platform lift machine includes a chassis, a work platform, a scissors lift mechanism, and a telescopable electro-mechanical actuation arrangement. The work platform is disposed above the chassis. The scissors lift mechanism has a plurality of portions pivotally movable relative to one another, an upper end portion pivotally mounting the work platform above the chassis, and a lower end portion pivotally mounted on the chassis. The pivotally movable portions are movable vertically between retracted and expanded conditions so as to move the work platform between lowered and raised positions relative to the chassis. The actuation arrangement extends and is mounted to selected upper and lower ones of the pivotally movable portions of the lift mechanism and is adapted to operate the lift mechanism between the retracted and expanded conditions. The actuation arrangement has a telescopable contractable and extendable component capable of varying in length and operable to undergo rotation in a first angular direction and translational contraction in length in a first linear direction so as to cause movement of the lift mechanism vertically toward the retracted condition and thereby movement of the work platform toward the lowered position. The telescopable component also is operable to undergo rotation in a second angular direction opposite to the first angular direction and translational extension in length in a second linear direction opposite to the first linear direction so as to cause movement of the lift mechanism vertically toward the expanded condition and thereby movement of the work platform toward the raised position.

19 Claims, 4 Drawing Sheets

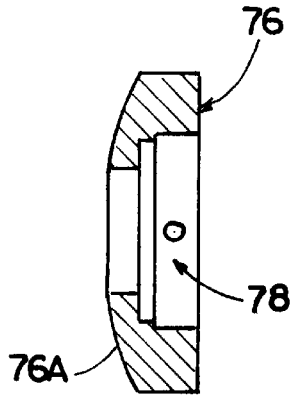
FIG. 16
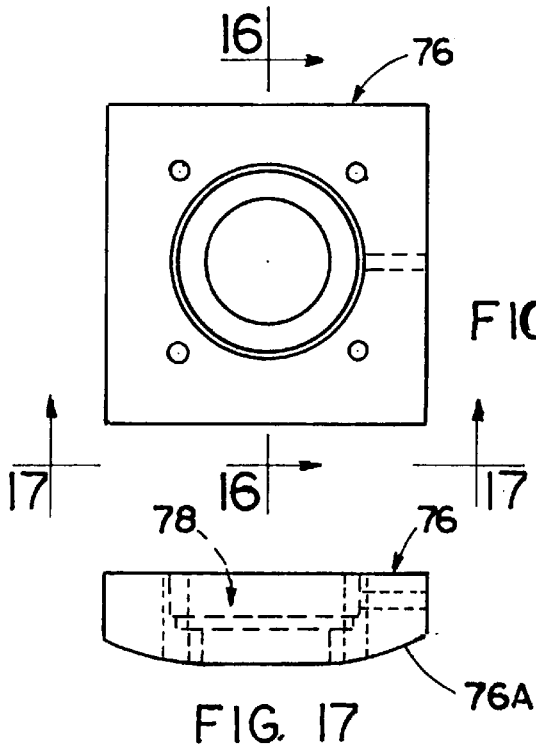
FIG. 15
FIG. 17
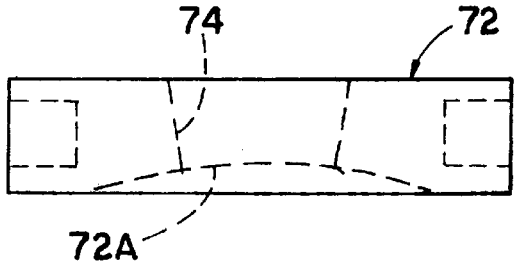
FIG. 19
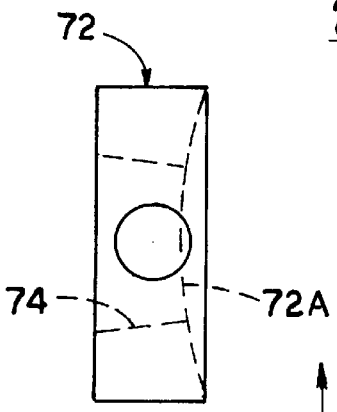
FIG. 20
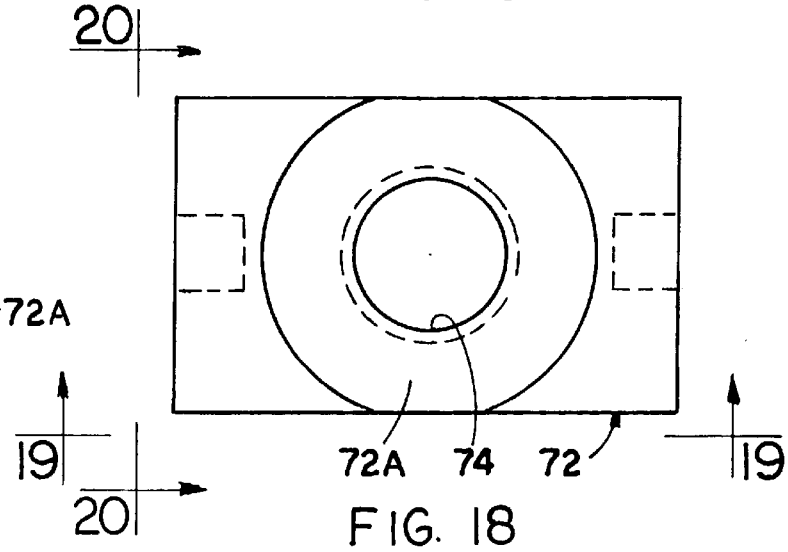
FIG. 18

WORK PLATFORM LIFT MACHINE WITH SCISSOR LIFT MECHANISM EMPLOYING TELESCOPABLE ELECTRO-MECHANICAL BASED LIFT ACTUATION ARRANGEMENT

CROSS REFERENCE TO RELATED APPLICATION

Reference is hereby made to the copending application Ser. No. 091063,809, filed Apr. 21, 1998, entitled "Scissors-Type Work Platform Lift Machine With Electro-Mechanical Based Lift Actuation Arrangement" and assigned to the same assignee as the present invention.

BACKGROUND OF THE INVENTION

1. Field of the Invention

The present invention generally relates to work platform lift machines and, more particularly, is concerned with a work platform lift machine with a scissor lift mechanism employing a telescopable electro-mechanical based lift actuation arrangement.

2. Description of the Prior Art

In various work platform lift machines, such as scissors lifts, elevated platforms, cranes, etc., hydraulic cylinders are used to provide the necessary lifting forces. One of most popular machines of this type in use is called an electric slab scissor lift machine. Electric slab scissor lift machines commercially available at present time from several manufacturers include a battery powered chassis having rear stationary wheels and front steerable wheels, a scissors lift mechanism mounted at a lower end on the chassis, a work platform mounted on an upper end of the lift mechanism for carrying workmen, and a hydraulic actuation system for operating the lift mechanism to raise and lower the work platform. The scissors lift mechanism includes a plurality of sets of arms pivotally interconnected in a scissor-like fashion so as to raise and lower as the arms pivot between generally vertical unstacked and horizontal stacked orientations relative to one another. The hydraulic actuation system generally employs one or more hydraulic cylinders for causing pivoting of the sets of arms to expand the lift mechanism by unstacking the sets of arms and thereby raise the work platform or to retract the lift mechanism by restacking the pairs of arms and thereby lower the work platform. Typically, the hydraulic cylinders are interconnected between an adjacent set of the arms.

The use of hydraulic actuation systems and positioning of the hydraulic cylinders in lift machines have several disadvantages. One major disadvantage is that hydraulic actuation systems leak hydraulic fluid which is a substance toxic to the environment and therefore requires a considerable amount of care and attention and must be contained and disposed of properly. In food, aerospace, pharmaceutical, silicon chip and other industries, cleanliness is very important and thus hydraulic fluid leakage and contamination cannot be tolerated. Another significant disadvantage of hydraulic actuation systems is that they are not very efficient, typically operating at levels ranging from fifty to sixty percent efficiency. Thus, lift machines that are hydraulically powered not only invite high maintenance and/or repair costs but also tend to tax the batteries that are used to drive the machines resulting in short run times before the batteries need to be recharged. Yet another important disadvantage is that using hydraulic cylinders within the scissors arm stack to raise the lift mechanism and thereby the work platform not only causes machine instability due to high centers of gravity, but also such hydraulic cylinders tend to be squishy and jerky in operation and thus hydraulic actuation systems lack smooth and precise control of the movement of the lift mechanism to raise and lower the working platform.

Consequently, a need exists for a different approach to actuation of the scissors lift mechanism of such lift machines which will overcome the above-mentioned disadvantages without introducing other disadvantages in their place.

SUMMARY OF THE INVENTION

The application cross-referenced above, whose disclosure is hereby incorporated herein by reference thereto, discloses an approach which substantially satisfies the aforementioned need by totally eliminating the use of a hydraulic actuation system for operating a scissors lift mechanism and by introducing in its place an electro-mechanical based actuation arrangement. The electro-mechanical based actuation arrangement of the cross-referenced application: (1) eliminates the environmental problems caused by hydraulic fluid leakage and the maintenance problems associated therewith; (2) operates with an efficiency rating ranging from eighty to ninety percent and thus substantially higher than that of the hydraulic based actuation system; (3) avoids the squishy and jerky operation of and "bounce" associated with the hydraulic actuation system by enabling a lifting motion that is smooth in operation and provides precise and definite control of operation; and (4) provides an unique lift geometry which reduces the lifting stresses on the pivotal scissors arms from around 35,000 pounds or more, as typically found on current scissors-type lift machines, down to only 5,000 to 7,000 pounds. This very large reduction in stress provides significant performance and maintenance advantages not only in the components of the machine itself but also reduces the demand on the electrical power supply.

The present invention greatly enhances the aforementioned numerous achievements of the approach of the cross-referenced application by providing a telescopable electro-mechanical based lift actuation arrangement which reduces material and operating costs and increases performance. The telescopable electro-mechanical based lift actuation arrangement of the present invention: (1) increases lifting capacity and thus, for the same maximum lifting capacity requirement as before, allows the use of an electric motor of smaller horsepower rating which reduces demand on electrical power supply and reduces component and operating costs; (2) permits reduction of at least half the length of a substantially high cost component in the form of an externally threaded ballscrew shaft, while still achieving the same maximum expansion in length of the lift actuation arrangement, by substituting substantially low cost components in the form of a rigid non-threaded extension tube on an internally threaded nut rotatable on the ballscrew shaft and a support bearing element rotatably supporting an end of the ballscrew shaft for rotational and translational movements along and within and relative to the extension tube; and (3) improves control over and stability of the lift actuation arrangement and thus performance thereof by eliminating the adverse affects of the lateral sloppiness inherent in the threadable rotatable fit of the externally threaded ballscrew shaft with the internally threaded nut. The employment of the nut with the extension tube and end support bearing element in a telescopable support relationship with the ballscrew shaft provides a telescopable electro-mechanical lift actuation arrangement which is effectively a rigid column or member in all directions transverse to the rotational and longitudinal translational axis of the baliscrew shaft of the lift actuation arrangement so that the entire lift force applied by rotation of the ballscrew shaft relative to the nut and extension tube is directed only axially along the lift actuation arrangement to expand and retract the same and cause the scissor lift mechanism to raise and lower the work platform.

Accordingly, the present invention is directed to a scissors-type work platform lift machine which comprises: (a) a chassis; (b) a work platform disposed above the chassis; (c) a scissors lift mechanism having a plurality of portions pivotally movable relative to one another, an upper end portion pivotally mounting the work platform above the chassis and a lower end portion pivotally mounted on the chassis, the pivotally movable portions being movable vertically between retracted and expanded conditions so as to move the work platform between lowered and raised positions relative to the chassis; and (d) an electro-mechanical actuation arrangement extending between and being mounted to selected upper and lower ones of the pivotally movable portions of the lift mechanism and adapted to operate the lift mechanism between the retracted and expanded conditions, the actuation arrangement having a telescopable contractable and extendable component capable of varying in length and operable to undergo rotation in a first angular direction and translational contraction in length in a first linear direction so as to cause movement of the lift mechanism vertically toward the retracted condition and thereby movement of the work platform toward the lowered position and to undergo rotation in a second angular direction opposite to the first angular direction and translational extension in length in a second linear direction opposite to the first linear direction so as to cause movement of the lift mechanism vertically toward the expanded condition and thereby movement of the work platform toward the raised position.

The lift mechanism extends vertically between the chassis and the work platform. The plurality of pivotally movable portions of the lift mechanism are sets of arms pivotally interconnected in a vertically extending scissor-like fashion with a lowermost one of the sets of arms pivotally and movably mounted on the chassis and an uppermost one of the sets of arms pivotally and movably mounting the work platform such that pivoting of the sets of arms relative to one another causes the lift mechanism to move vertically between the retracted condition in which the work platform is in the lowered position adjacent to the chassis and the expanded condition in which the work platform is in the raised position remote above the chassis. The sets of arms in the retracted condition of the lift mechanism are in a substantially stacked relationship with one another and in the expanded condition of the lift mechanism are in a substantially unstacked relationship with one another.

The telescopable component of the actuation arrangement includes an externally threaded ballscrew shaft having opposite first and second ends and being rotatable in the first and second angular directions, an internally threaded nut threadably rotatable on the ballscrew shaft and in response to rotation of the ballscrew shaft in the opposite first and second angular directions being movable in the opposite first and second linear directions between a retracted position wherein the nut is located adjacent to the first end of the ballscrew shaft and an extended position wherein the nut is located adjacent to the second end of the ballscrew shaft, and an extension tube having opposite first and second ends and being attached at the first end to the nut for undergoing movement therewith in the opposite first and second linear directions and spaced radially outwardly from and extending over and axially along the ballscrew shaft to the second end of the extension tube being disposed adjacent to the second end of the ballscrew shaft when the nut is in the retracted position and spaced from the second end of the ballscrew shaft when the nut is in the extended position. The telescopable component of the actuation arrangement also includes a support bearing element rotatably coupled to and supporting the second end of the ballscrew shaft within the extension tube. The nut and extension tube together are adapted to undergo telescoping translational contraction and extension relative to the ballscrew shaft and support bearing element as the ballscrew shaft is correspondingly rotated in the first and second angular directions so as to thereby contract and extend the length of the telescopable component to cause movement of the lift mechanism between the retracted and expanded conditions.

The telescopable actuation arrangement further includes an upper joint, a lower joint and an electric motor. The upper joint is centrally disposed between and pivotally couples the second end of the extension tube to a selected upper one of the sets of arms of the lift mechanism. The lower joint pivotally couples the first end of the ballscrew shaft to a selected lower one of the sets of arms of the lift mechanism and adapts the ballscrew shaft for undergoing limited universal pivotal movement relative to the selected lower one of the sets of arms of the lift mechanism as the latter is moved between the expanded and retracted conditions. The electric motor is drivingly coupled to the second end of the ballscrew shaft below the lower joint of the actuation arrangement.

These and other features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the following detailed description, reference will be made to the attached drawings in which:

FIG. 15 is an enlarged top plan view of a ball bearing block of an universal ball joint of the telescopable electro-mechanical actuation arrangement of FIG. 4.

FIG. 16 is a cross-sectional view of the ball bearing block taken along line 16—16 of FIG.15.

FIG. 17 is a side elevational view of the ball bearing block as seen along line 17—17 of FIG. 15.

FIG. 18 is an enlarged top plan view of a ball support block of the universal ball joint of the electro-mechanical actuation arrangement of FIG. 4.

FIG. 19 is a side elevational of the ball support block as seen along line 19—19 of FIG. 18.

FIG. 20 is an end elevational view of the ball support block as seen along line 20—20 of FIG. 18.

DETAILED DESCRIPTION OF THE INVENTION

Figure 1:
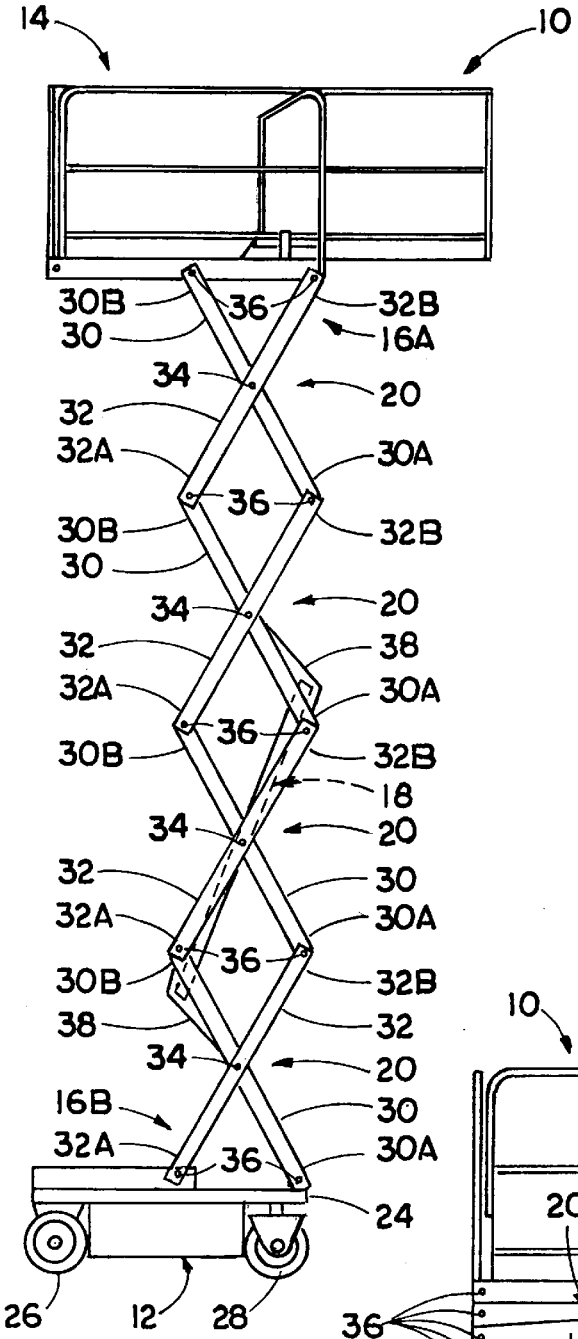
FIG. 1 is a side elevational view of a work platform lift machine with a scissor lift mechanism incorporating a telescopable electro-mechanical based actuation arrangement in accordance with the principles of the present invention, showing the scissor lift mechanism in an expanded condition and the work platform in a raised position by operation of the telescopable electro-mechanical actuation arrangement.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

Referring to the drawings and particularly to FIGS. 1 to 6, there is illustrated a scissors-type work platform lift machine, generally designated 10, of the present invention. The lift machine 10 basically includes a chassis 12, a work platform 14, a scissors lift mechanism 16, and a telescopable electro-mechanical actuation arrangement 18. The work platform 14 is disposed above the chassis 12. The scissors lift mechanism 16 extends vertically between the chassis 12 and work platform 14 and has an upper end 16A pivotally mounting the work platform 14 above the chassis 12 and a lower end 16B pivotally mounted on the chassis 12. The lift mechanism 16 has a plurality of portions in the form of sets of arms 20 being pivotally interconnected in a scissors-like fashion and movable relative to one another between expanded and retracted conditions so as to move the work platform 14 between raised and lowered positions relative to the chassis 12, as respectively seen in FIGS. 1 and 2.

The actuation arrangement 18 extends between and is mounted to selected upper and lower ones of the sets of pivotally movable arms 20 of the lift mechanism 16 and is adapted to operate the lift mechanism 16 between the expanded and retracted conditions. The actuation arrangement 18 has a variable length telescopable contractable and extendable component 22 capable of varying in length and operable to undergo rotation in a first angular direction and translational contraction to minimum length in a first linear direction so as to cause movement of the lift mechanism 16 vertically toward the retracted condition and thereby movement of the work platform 14 toward the lowered position. The telescopable component 22 also is operable to undergo rotation in a second angular direction opposite to the first angular direction and translational extension to maximum length in a second linear direction opposite to the first linear direction so as to cause movement of the lift mechanism 16 vertically toward the expanded condition and thereby movement of the work platform 14 toward the raised position.

Figure 3:
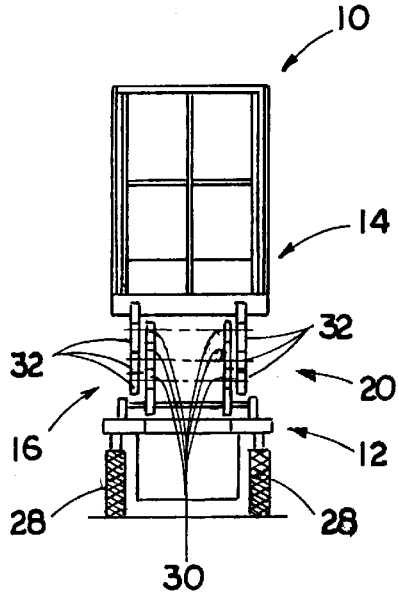
FIG. 3 is a front elevational view of the lift machine as seen alone line 3—3 of FIG. 2.
Figure 2:
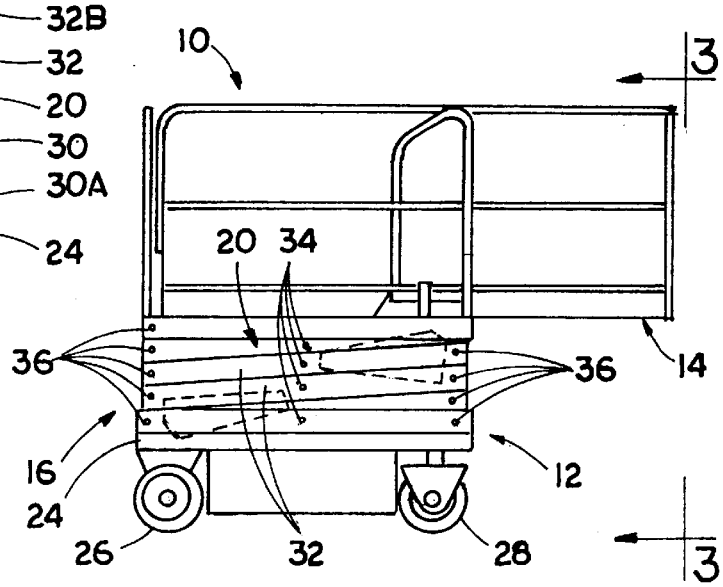
FIG. 2 is a side elevational view of the lift machine of FIG. 1 showing the scissors lift mechanism in a retracted condition and the work platform in a lowered position by operation of the telescopable electro-mechanical actuation arrangement.

Referring now to FIGS. 1 to 3, the chassis 12 includes a frame 24 having a substantially rectangular configuration, a pair of rear stationary wheels 26 and a pair of front steerable wheels 28. The rear wheels 26 and front wheels 28 are disposed adjacent to the opposite ends of the chassis frame 24 which is thereby made mobile. The lift mechanism 16 is of a type conventional per se in the art. As mentioned above, the lift mechanism 16 extends vertically between the chassis 12 and work platform 14 and includes the plurality of sets of pivotally interconnected arms 20. A lowermost one of the sets of arms 20 is pivotally and movably mounted on the chassis 12 and an uppermost one of the sets of arms 20 pivotally and movably mounts the work platform 14 such that pivoting of the sets of arms 20 relative to one another causes the lift mechanism 16 to move vertically upward and downward between the expanded condition in which the work platform 14 is in the raised position remote above the chassis 12, as shown in FIG. 1, and the retracted condition in which the work platform 14 is in the lowered position adjacent to the chassis 12, as shown in FIGS. 2 and 3. As is readily apparent with reference to FIGS. 1 and 2 respectively, the sets of arms 20 in the expanded condition of the lift mechanism 16 are in a substantially unstacked relationship with one another and in the retracted condition of the lift mechanism 16 are in a substantially stacked relationship with one another.

Each set of arms 20 of the lift mechanism 16 includes a pair of inside arms 30 and a pair of outside arms 32. Each inside and outside arm 30, 32 is of a rigid hollow tubular construction having a substantially rectangular configuration in transverse cross-section, though it may have any other suitable configuration, and has a length similar to the length of the frame 24 of the chassis 12. Each inside and outside arm 30, 32 has a pair of opposite ends 30A, 30B and 32A, 32B and is disposed in substantially parallel relation to the other respective inside and outside arm 30, 32 of the pair. The lift mechanism 14 also includes a plurality of rigid midpoint and end cross members 34, 36 extending between and pivotally connected respectively with adjacent ones of the inside and outside arms 30, 32 at midpoints thereof and with the opposite ends 30A, 30B and 32A, 32B of the respective inside and outside arms 30, 32 for pivotally coupling the inside arms 30 with the outside arms 32 respectively positioned outboard of the inside arms 30 or in the case of the lowermost and uppermost sets of arms 20 for pivotally coupled them with the chassis 12 and work platform 14. The work platform 14 is of any suitable type such as the one shown in FIG. 1. An underside of the work platform 14 is mounted to the uppermost set of inside and outside arms 30, 32 in a fashion substantially similar to the mounting of the lowermost set of inside and outside arms 30, 32 to the chassis frame 24 such that some of the respective uppermost and lowermost sets of arms 20 can move in a lengthwise direction relative to the work platform 14 and chassis frame 24 so as to allow for the expansion and retraction of the lift mechanism 16.

By the above-described assembly of the lift mechanism 16, adjacent inside and outside arms 30, 32 form a "X" configuration in relation to one another. Each "X" subassembly which comprises adjacent pairs of inside and outside arms 30, 32 may be referred to as a scissors section. The lift mechanism 16 can be of any suitable size, though typically ranges from fifteen to thirty-five feet in height, which depends on the expanded height of each scissors section and the number of sections comprising the lift mechanism 16. For illustration purposes, the machine 10 shown in FIGS. 1 to 3 includes four scissor sections.

Figure 4:
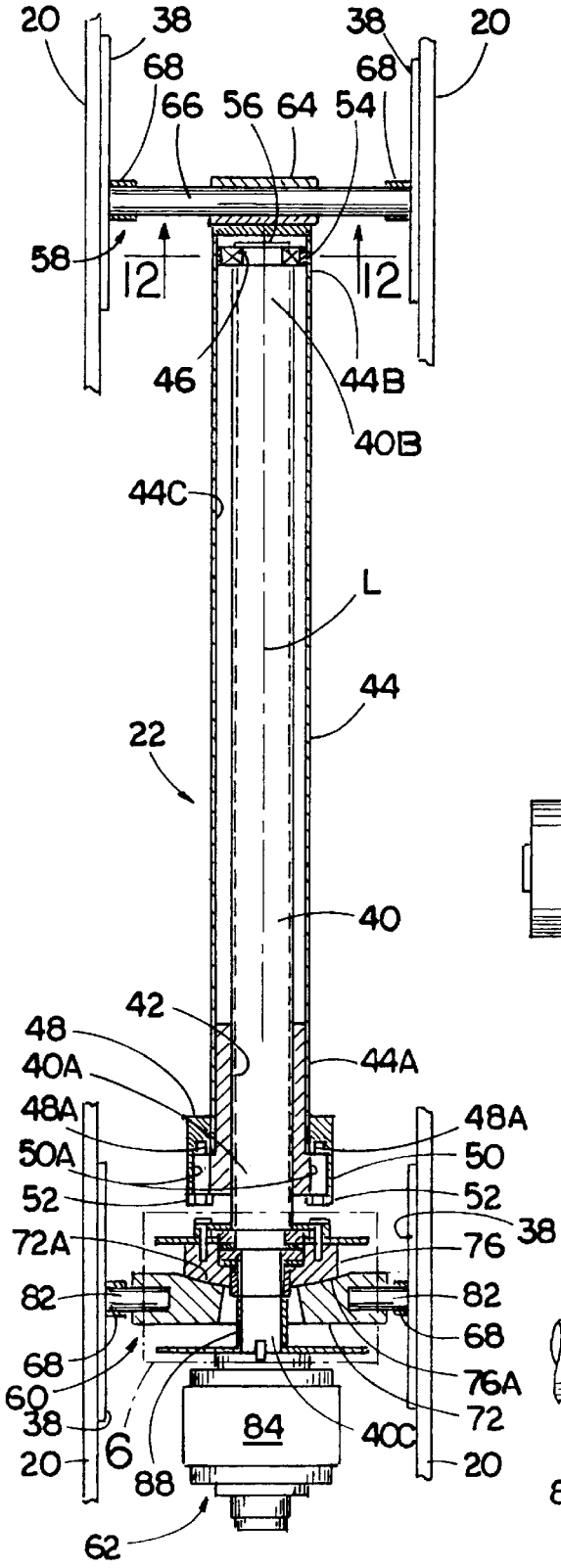
FIG. 4 is an enlarged longitudinal sectional view of the telescopable electro-mechanical actuation arrangement of the scissors lift mechanism, showing the arrangement in a retracted position.

Referring now to FIGS. 4 to 20, the actuation arrangement 18, which is also a feature of the present invention, extends between and is mounted to the selected upper and lower ones of the sets of arms 20 by pairs of gusset plates 38 attached to the selected sets of arms 20, as best seen in FIGS. 1, 2 and 4. The actuation arrangement 18 is positioned at a relatively shallow angle relative to a horizontal reference when the lift mechanism 16 is in the retracted condition, as shown in FIG. 2, and is positioned at a relatively steep angle relative to the horizontal reference when the lift mechanism 16 is in the expanded condition, as shown in FIG. 1.

The variable length telescopable component 22 of the actuation arrangement 18 basically includes an externally threaded ballscrew shaft 40, an internally threaded nut 42, an extension tube 44 and a support bearing member 46. The ballscrew shaft 40 of the component 22 has opposite first and second ends 40A, 40B and is mounted for rotation in the opposite first and second angular directions about its longitudinal axis L. The ballscrew shaft 40 per se may be a commercially available item, such as model 5 BSJ sold under the "Actionjac" trademark.

Figure 5:
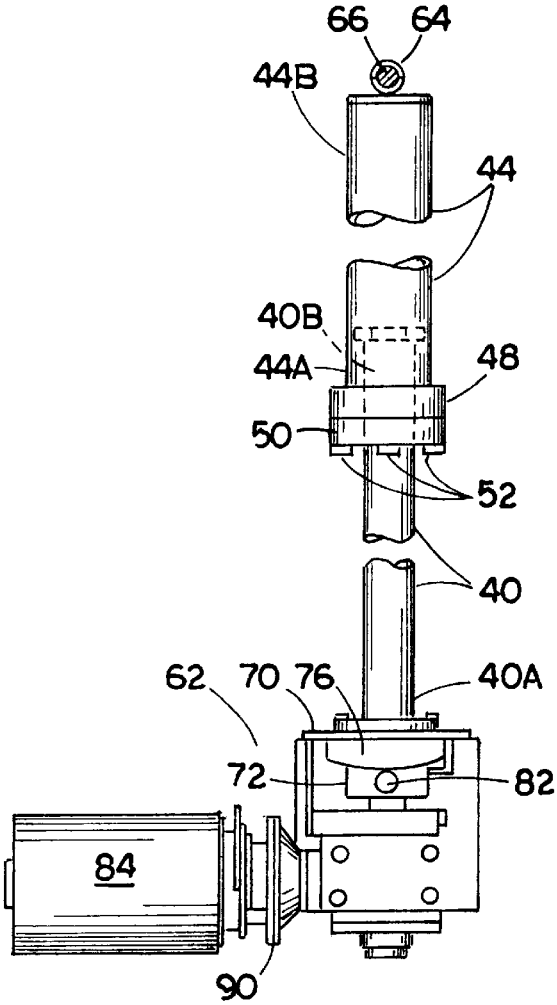
FIG. 5 is a side elevational view of the telescopable electro-mechanical actuation arrangement, showing the arrangement in an expanded condition.
Figure 6:
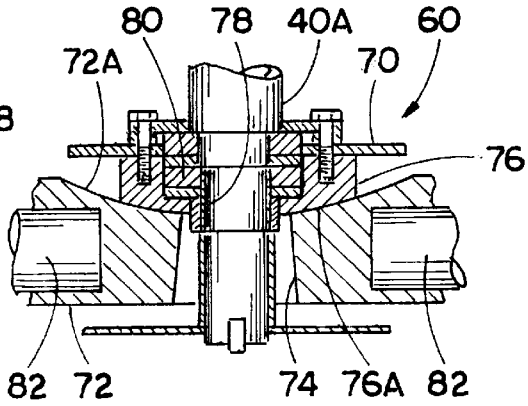
FIG. 6 is an enlarged detailed view of a lower joint of the telescopable electro-mechanical actuation arrangement enclosed in rectangle 6 of FIG. 4.
Figure 8:
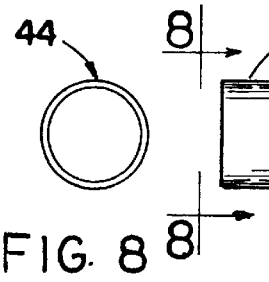
FIG. 8 is an end elevational view of the extension tube as seen along line 8—8 of FIG. 7.
Figure 7:
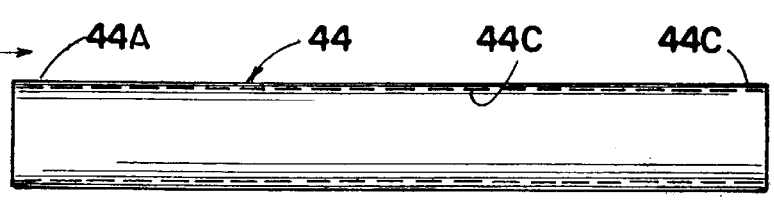
FIG. 7 is a side elevational view of an extension tube of the telescopable electro-mechanical actuation arrangement of FIG. 4.
Figure 9:
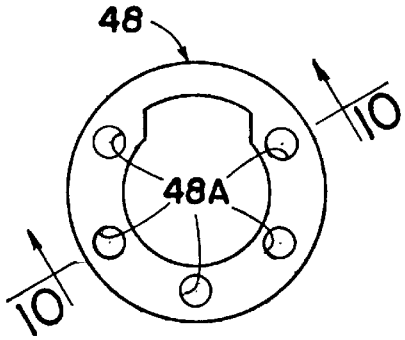
FIG. 9 is an enlarged end elevational view of a mounting collar of the telescopable electro-mechanical actuation arrangement of FIG. 4.
Figure 10:
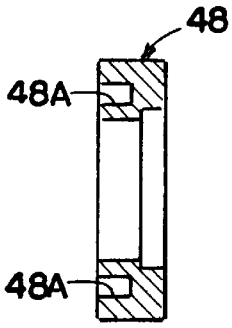
FIG. 10 is an axial sectional view of the mounting collar taken along line 10—10 of FIG. 9.
Figure 13:
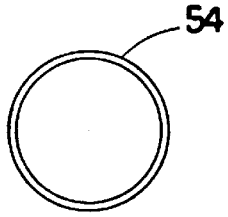
FIG. 13 is an end elevational view of the wear band of FIG. 12.
Figure 11:
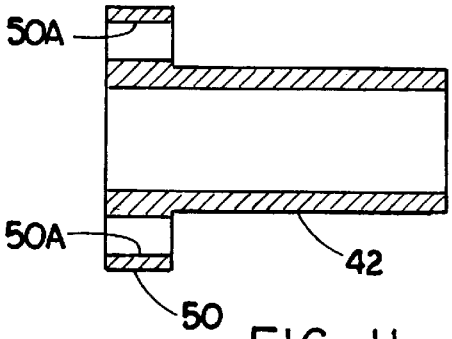
FIG. 11 is a longitudinal sectional view of an internally threaded nut of the telescopable electro-mechanical actuation arrangement of FIG. 4.
Figure 12:
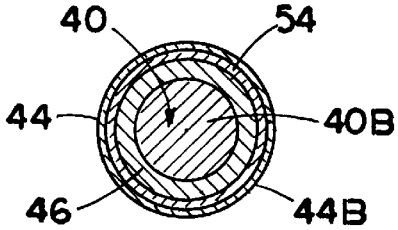
FIG. 12 is an enlarged cross-sectional view of the extension tube and a ballscrew shaft, support bearing and wear band of the telescopable electro-mechanical actuation arrangement of FIG. 4.
Figure 14:
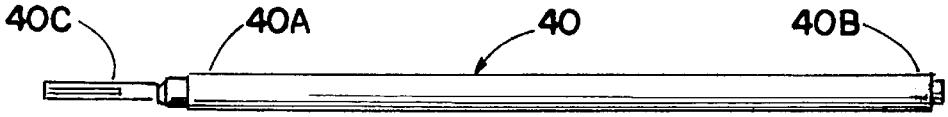
FIG. 14 is a side elevational view of the ballscrew of the telescopable electro-mechanical actuation arrangement of FIG. 4.

The internally threaded nut 42 of the component 22 is threadably rotatable on the externally threaded ballscrew shaft 40. In response to rotation of the ballscrew shaft 40 in a respective one of the opposite first and second angular directions, the nut 42 moves correspondingly in a respective one of the opposite first and second linear directions between a retracted position, as seen in FIG. 4, wherein the nut 42 is located adjacent to the first end 40A of the ballscrew shaft 40 and an extended position, as seen in FIG. 5, wherein the nut 42 is located adjacent to the second end 40B of the ballscrew shaft 40.

The extension tube 44 of the component 22 has opposite first and second ends 44A, 44B and is fastened at its first end 44A to the nut 42 for undergoing movement therewith in the opposite first and second linear directions. Specifically, the extension tube 44 has an annular collar 48 rigidly attached about its first end 44A while the nut 42 has an annular flange 50 formed about it. Circumferentially spaced apart and internally threaded holes 48A and 50A defined in the respective collar 48 and flange 50 are aligned with each other to threadably receive respective bolts 52 and thereby rigidly fasten the extension tube 44 to the nut 42. The extension tube 44 is spaced radially outwardly from and extends over and axially along the ballscrew shaft 40. The second end 44B of the extension tube 44 is disposed adjacent to the second end 40B of the ballscrew shaft 40, as seen in FIG. 4, when the nut 42 is in the retracted position, and is spaced from the second end 40B of the ballscrew shaft 40, as seen in FIG. 5, when the nut 42 is in the extended position. It can be readily understood that the telescoping relationship of the extension tube 44 over the ballscrew shaft 40 produces the contraction or decrease and extension or increase of the variable length of the telescopable component 22 of the actuation arrangement 18 which permits the employment of a ballscrew shaft 40 having about one-half the length of the ballscrew shaft of the cross-referenced application. In the exemplary embodiment the extension tube 44 has approximately the same length as the externally threaded portion of the ballscrew shaft 40, although other lengths of the shaft 40 and tube 44 can be provided.

The support bearing element 46 of the component 22 is rotatably coupled to and supports the second end 40B of the ballscrew shaft 40 within the extension tube 44. The nut 42 and extension tube 44 together are adapted to undergo telescoping translational contraction and extension relative to the ballscrew shaft 40 and support bearing element 46 as the ballscrew shaft 40 is correspondingly rotated in the first and second angular directions so as to thereby contract and extend the length of the telescopable component 22 to cause movement of the lift mechanism 16 between the retracted and expanded conditions. The telescopable component 22 further includes a wear band 54 disposed about the support bearing element 46 between the support bearing element 46 and the inside surface 44C of the extension tube 44, and a snap ring 56 fitted on the second end 40B of the ballscrew shaft 40 so as to hold the support bearing element 46 in place on the second end 40B of the ballscrew shaft 40. The bearing element 46 has an inner race that rotates with the ballscrew shaft 40 and an outer race which is enclosed by the wear band 54. The wear band 54 contacts the inside surface of the enclosure tube 44 and protects the bearing element 46 from wear due to friction with the extension tube 44.

The actuation arrangement 18 further includes an upper joint 58, a lower joint 60 and a drive means 62. The upper joint 58 of the arrangement 18 is disposed between the selected upper one set of arms 20 of the lift mechanism 16 and pivotally couples the second end 44B of the extension tube 44 therewith so that the component 22 can pivot about an upper transverse axis relative to the upper one set of arms 20 as the lift mechanism 16 is moved between the expanded and retracted conditions. The upper joint 58 includes a transverse sleeve 64 attached across the second end 44B of the extension tube 44 and a pivot member 66 extending through the sleeve 64. The pivot member 66 defines the upper transverse pivotal axis and at its opposite ends 66A is fitted into and pivotally coupled to the upper one set of arms 20 via collars 68 fixed on the facing interior sides of the gusset plates 38 attached to the upper one set of arms 20.

The lower joint 60 of the arrangement 18 is disposed between the selected lower one set of arms 20 of the lift mechanism 16 and pivotally couples the first end 40A of the ballscrew shaft 40 therewith so as to adapt the ballscrew shaft 40 at its first end 40A to undergo limited universal pivotal movement relative to the selected lower one set of arms 20 as the lift mechanism 16 is moved between the expanded and retracted conditions. The lower joint 60 includes an outer housing 70, a ball support block 72 attached to the outer housing 70 and having a central bore 74 receiving therethrough an unthreaded lower end portion 40C of the first end 40A of the ballscrew shaft 40, a ball bearing block 76 attached to the outer housing 70 and overlying the ball support block 72 and having a central hole 78 receiving therethrough the unthreaded lower end portion 40C of the ballscrew shaft 40, a thrust bearing 80 receiving therethrough and rotatably engaging the unthreaded lower end portion 40C of the ballscrew shaft 40, and a pair of support pins 82 mounted to and extending outwardly from and on opposite sides of the ball support block 72. The thrust bearing 80 fits into the ball bearing block 76. The ball support block 72 and the ball bearing block 76 together comprise a limited universal ball joint. The ball support block 72 has a concave top surface 72A and defines the central bore 74 having a cone-shaped configuration which allows for side-to-side pivotal movement of the lower end portion 40C of the ballscrew shaft 40 as the ball bearing block 76 at its convex-shaped bottom 76A moves swivel-like about the concave top surface 72A of the ball support block 72 so as to compensate for side loading of the ballscrew shaft 40. The support pins 82 are rotatably received in collars 68 on the gusset plates 38 attached on the selected lower set of arms 20.

The drive means 62 includes an electric motor 84 and a gearbox 86 supporting the electric motor 84 and in turn mounted to the outer housing 70 of the lower joint 60. The gearbox 86 drivingly couples the electric motor 84 to the unthreaded lower end portion 40C of the ballscrew shaft 40 below the lower joint 60. The gearbox 86 has an internal sleeve 88 receiving and keyed to the lower end portion 40C of the ballscrew shaft 40. The sleeve 88 is rotatable by the gearbox 86 and driven by the electric motor 84 for causing selected rotation of the ballscrew shaft 40 between the first and second angular directions. The electric motor 84 further has a matrix brake 90 disposed between the electric motor 84 and gearbox 86. The actuation arrangement 18 further includes a dust boot (not shown) mounted between the upper and lower joints 58, 60 for covering the telescopable component 22 of the actuation arrangement 18.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiments thereof.

What is claimed is:

1. A scissors work platform lift machine, comprising:

(a) a chassis;

(b) a work platform disposed above said chassis;

(c) a scissors lift mechanism having a plurality of portions pivotally movable relative to one another, an upper end portion pivotally mounting said work platform above said chassis and a lower end portion pivotally mounted on said chassis, said pivotally movable portions being movable vertically between retracted and expanded conditions so as to move said work platform between lowered and raised positions relative to said chassis; and (d) an electro-mechanical actuation arrangement extending between and being mounted to selected upper and lower ones of said pivotally movable portions of said lift mechanism and adapted to operate said lift mechanism between said retracted and expanded conditions, said actuation arrangement having a telescopable contractable and extendable component capable of varying in length and operable to undergo rotation in a first angular direction and translational contraction in length in a first linear direction so as to cause movement of said lift mechanism vertically toward said retracted condition and thereby movement of said work platform toward said lowered position and to undergo rotation in a second angular direction opposite to said first angular direction and translational extension in length in a second linear direction opposite to said first linear direction so as to cause movement of said lift mechanism vertically toward said expanded condition and thereby movement of said work platform toward said raised position, said telescopable component of said actuation arrangement including:

an externally threaded ballscrew shaft having opposite first and second ends and being rotatable in said opposite first and second angular directions;

an internally threaded nut threadably rotatable on said ballscrew shaft and in response to rotation of said ballscrew shaft in said opposite first and second angular directions being movable in said opposite first and second linear directions between a retracted position wherein said nut is located adjacent to said first end of said ballscrew shaft and an extended position wherein said nut is located adjacent to said second end of said ballscrew shaft; and an extension tube having opposite first and second ends and being attached at said first end to said nut for undergoing movement therewith in said opposite first and second linear directions and spaced radially outwardly from and extending over and axially along said ballscrew shaft to said second end of said extension tube being disposed adjacent to said second end of said ballscrew shaft when said nut is in said retracted position and spaced from said second end of said ballscrew shaft when said nut is in said extended position.

2. The machine as recited in claim 1, wherein said telescopable component of said actuation arrangement further includes a support bearing element rotatably coupled to and supporting said second end of said baliscrew shaft within said extension tube, said nut and extension tube together adapted to undergo telescoping translational contraction and extension relative to said ballscrew shaft and support bearing element as said ballscrew shaft is correspondingly rotated in said first and second angular directions so as thereby contract and extend the length of said telescopable component to cause movement of said lift mechanism between said retracted and expanded conditions.

3. The machine as recited in claim 2, wherein said telescopable component of said actuation arrangement further includes a wear band disposed about said support bearing element between said support bearing element and said extension tube.

4. The machine as recited in claim 1, wherein said actuation arrangement further includes an upper joint pivotally coupling said second end of said extension tube to said selected upper one of said pivotally movable portions of said lift mechanism.

5. The machine as recited in claim 4, wherein said actuation arrangement further includes a lower joint pivotally coupling said first end of said ballscrew shaft to said selected lower one of said pivotally movable portions of said lift mechanism so as to adapt said ballscrew shaft at said first end thereof to undergo limited universal pivotal movement relative to said selected lower one of said pivotally movable portions of said lift mechanism as said lift mechanism is moved between said expanded and retracted conditions.

6. The machine as recited in claim 5, wherein said lower joint includes:

a ball support block having a pair of support pins mounted to and extending outwardly from and on opposite sides thereof for rotatable connection with said selected lower one of said pivotally movable portions of said lift mechanism; and a ball bearing block overlying said ball support block so as to form a ball joint therewith, said first end of said ballscrew shaft extending through said ball joint and adapted to undergo side-to-side pivotal movement relative thereto and thereby said limited universal pivotal movement relative to said selected lower one of said pivotally movable portions of said lift mechanism.

7. The machine as recited in claim 6, wherein:

said ball support block has a concave top surface and a central bore with a cone-shaped configuration which allows for said side-to-side pivotal movement of said first end of said ballscrew shaft; and said ball bearing block has a convex bottom surface which permits swivel-like motion about said concave top surface of said ball support block so as to compensate for side loading of said ballscrew shaft during raising and lowering of said lift mechanism by said actuation arrangement.

8. The machine as recited in claim 5, wherein said actuation arrangement further includes an electric motor drivingly coupled to said first end of said ballscrew shaft below said lower joint of said actuation arrangement.

9. A scissors work platform lift machine, comprising:

(a) a chassis;

(b) a work platform disposed above said chassis;

(c) a scissors lift mechanism extending vertically between said chassis and said work platform, said lift mechanism including a plurality of sets of arms pivotally interconnected in a vertically extending scissor fashion with a lowermost one of said sets of arms pivotally and movably mounted on said chassis and an uppermost one of said sets of arms pivotally and movably mounting said work platform above said chassis such that pivoting of said sets of arms relative to one another causes said lift mechanism to move vertically between a retracted condition in which said work platform is in a lowered position adjacent to said chassis and an expanded condition in which said work platform is in a raised position remote above said chassis, said sets of arms in said retracted condition of said lift mechanism being in a substantially stacked relationship with one another and in said expanded condition of said lift mechanism being in a substantially unstacked relationship with one another; and (d) an electro-mechanical actuation arrangement mounted to and extending between selected first and second ones of said sets of arms of said lift mechanism and operable to move said lift mechanism between said retracted and expanded conditions, said actuation arrangement having a telescopable contractable and extendable component capable of varying in length and adapted to operate said lift mechanism between said retracted and expanded conditions, the telescopable component including (i) an externally threaded ballscrew shaft having opposite first and second ends and being rotatable in opposite first and second angular directions, (ii) an internally threaded nut threadably rotatable on said ballscrew shaft and in response to rotation of said ballscrew shaft in said opposite first and second angular directions being movable in opposite first and second linear directions between a retracted position wherein said nut is located adjacent to said first end of said ballscrew shaft and an extended position wherein said nut is located adjacent to said second end of said ballscrew shaft, (iii) an extension tube having opposite first and second ends and being attached at said first end to said nut for undergoing movement therewith in said opposite first and second linear directions and spaced radially outwardly from and extending over and axially along said ballscrew shaft to said second end of said extension tube being disposed adjacent to said second end of said ballscrew shaft when said nut is in said retracted position and spaced from said second end of said ballscrew shaft when said nut is in said extended position, and (iv) a support bearing element rotatably coupled to and supporting said second end of said ballscrew shaft within said extension tube, said nut and extension tube together adapted to undergo telescoping translational contraction and extension relative to said ballscrew shaft and support bearing element as said ballscrew shaft is correspondingly rotated in said first and second angular directions so as to thereby contract and extend the length of said telescopable component to cause movement of said lift mechanism between said retracted and expanded conditions.

10. The machine as recited in claim 9, wherein said telescopable component of said actuation arrangement further includes a wear band disposed about said support bearing element between said support bearing element and said extension tube.

11. The machine as recited in claim 9, wherein said actuation arrangement further includes an upper joint disposed between said arms of said selected first one set and pivotally coupling said arms of said selected first one set to said second end of said extension tube.

12. The machine as recited in claim 11, wherein said actuation arrangement further includes a lower joint disposed between said arms of said selected second one set and pivotally coupling said arms of said selected second one set to said first end of said ballscrew shaft so as to adapt said ballscrew shaft at said first end thereof to undergo limited universal pivotal movement relative to said selected second one set of arms as said lift mechanism is moved between said expanded and retracted conditions.

13. The machine as recited in claim 12, wherein said lower joint includes:

a ball support block having a pair of support pins mounted to and extending outwardly from and on opposite sides thereof for rotatable connection with said arms of said selected second one set thereof; and a ball bearing block overlying said ball support block so as to form a ball joint therewith, said first end of said ballscrew shaft extending through said ball joint and adapted to undergo side-to-side pivotal movement relative thereto and thereby said limited universal pivotal movement relative to said selected second one set of said lift mechanism.

14. The machine as recited in claim 13, wherein:

said ball support block has a concave top surface and a central bore with a cone-shaped configuration which allows for said side-to-side pivotal movement of said first end of said ballscrew shaft; and said ball bearing block has a convex bottom surface which permits swivel-like motion about said concave top surface of said ball support block so as to compensate for side loading of said ballscrew shaft during raising and lowering of said lift mechanism by said actuation arrangement.

15. The machine as recited in claim 12, wherein said actuation arrangement further includes an electric motor drivingly coupled to said first end of said ballscrew shaft below said lower joint of said actuation arrangement.

16. A variable length telescopable electro-mechanical actuation arrangement, comprising:

(a) an externally threaded ballscrew shaft having opposite first and second ends and being rotatable in opposite first and second angular directions;

(b) an internally threaded nut threadably rotatable on said ballscrew shaft and in response to rotation of said ballscrew shaft in said opposite first and second angular directions being movable in opposite first and second linear directions between a retracted position wherein said nut is located adjacent to said first end of said ballscrew shaft and an extended position wherein said nut is located adjacent to said second end of said ballscrew shaft;

(c) an extension tube having opposite first and second ends and being attached at said first end to said nut for undergoing movement therewith in said opposite first and second linear directions and spaced radially outwardly from and extending over and axially along said ballscrew shaft to said second end of said extension tube being disposed adjacent to said second end of said ballscrew shaft when said nut is in said retracted position and spaced from said second end of said ballscrew shaft when said nut is in said extended position;

(d) a support bearing element rotatably coupled to and supporting said second end of said ballscrew shaft within said extension tube, said nut and extension tube together adapted to undergo telescoping translational contraction and extension relative to said ballscrew shaft and support bearing element as said ballscrew shaft is correspondingly rotated in said first and second angular directions so as to thereby contract and extend in length said telescopable actuation arrangement;

(e) an upper joint pivotally coupled to said second end of said extension tube for pivotally connecting said second end of said extension tube to a first external structure; and (f) a lower joint pivotally coupled to said first end of said ballscrew shaft for pivotally connecting said first end of said ballscrew shaft to a second external structure so as to adapt said ballscrew shaft at said first end to undergo limited universal pivotal movement relative thereto, said lower joint including a ball support block having a pair of support pins mounted to and extending outwardly from and on opposite sides thereof for rotatable connection with the second external structure; and a ball bearing block overlying said ball support block so as to form a ball joint therewith, said first end of said ballscrew shaft extending through said ball joint and adapted to undergo side-to-side pivotal movement relative thereto and thereby said limited universal pivotal movement relative to the second external structure.

17. The arrangement as recited in claim 16, further comprising:

a wear band disposed about said support bearing element between said support bearing element and said extension tube.

18. The arrangement as recited in claim 16, wherein:

said ball support block has a concave top surface and a central bore with a cone-shaped configuration which allows for side-to-side pivotal movement of said first end of said ballscrew shaft; and said ball bearing block has a convex bottom surface which permits swivel-like motion about said concave top surface of said ball support block so as to compensate for side loading of said ballscrew shaft during operation of said telescopable actuation arrangement.

19. The arrangement as recited in claim 16, further comprising:

an electric motor drivingly coupled to said second end of said ballscrew shaft below said lower joint of said telescopable actuation arrangement.

* * * * *